United States Patent [19]

Cadenhead, Sr.

[11] Patent Number: 4,617,208

[45] Date of Patent: Oct. 14, 1986

[54] NON-DIRECTIONAL, SYNTHETIC, OUTDOOR CARPET

[75] Inventor: Roy A. Cadenhead, Sr., Calhoun, Ga.

[73] Assignee: Modern Fibers, Inc., Calhoun, Ga.

[21] Appl. No.: 515,132

[22] Filed: Jul. 19, 1983

[51] Int. Cl.[4] ..... A01N 3/00

[52] U.S. Cl. ..... 428/17; 28/159; 156/61; 156/72; 156/148; 156/221; 264/230; 264/345; 273/DIG. 13; 428/92; 428/96

[58] Field of Search ..... 28/159; 264/230, 345; 428/17, 96, 92; 156/72, 221, 148, 61; 273/DIG. 13

[56] References Cited

U.S. PATENT DOCUMENTS

| | | | |
|---|---|---|---|
| 3,309,259 | 3/1967 | Schwartz | 156/72 |
| 3,332,828 | 7/1967 | Faria et al. | 156/72 |
| 3,573,147 | 3/1971 | Elbert | 428/17 |
| 3,837,980 | 9/1974 | Nishimura et al. | 428/17 |
| 3,940,522 | 2/1976 | Wessells | 428/17 |
| 4,061,804 | 12/1977 | McCulloch | 428/17 |
| 4,265,849 | 5/1981 | Borenstein | 156/72 |

FOREIGN PATENT DOCUMENTS

| | | | |
|---|---|---|---|
| 48-15714 | 5/1973 | Japan | 28/159 |
| 1163732 | 9/1969 | United Kingdom . | |

*Primary Examiner*—John J. Gallagher

*Attorney, Agent, or Firm*—Sutherland, Asbill & Brennan

[57] ABSTRACT

A process of making a cut pile, tufted carpet that is non-directional is disclosed. It comprises the steps of:

(a) knitting a yarn composed of thermoplastic fiber, e.g., continuous filament polypropylene ribbon, into a deknittable fabric, (b) heating the fabric to a temperature at which the curves and bends generated in the yarn by its knitted configuration are established in the yarn's memory, (c) cooling the fabric to about room temperature, (d) deknitting the cooled fabric and rewinding the yarn under enough tension to restraighten it, (e) tufting the yarn as facing yarn into a primary carpet backing material, forming a cut pile carpet, (f) coating the underside of the carpet with a heat-settable adhesive that, when cured, will help anchor the tufts of yarn in the backing material, and (g) heating the adhesive-coated carpet to a temperature at which the adhesive will set and the facing yarn will reconform to the bends and twists in its memory.

31 Claims, 4 Drawing Figures

NON-DIRECTIONAL, SYNTHETIC, OUTDOOR CARPET

Figure 1:
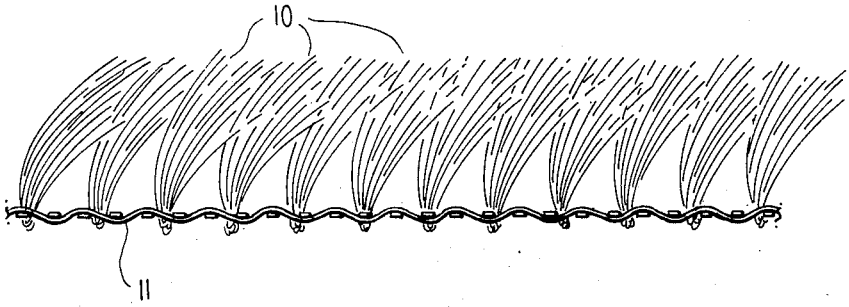

This invention has to do with cut pile, tufted carpets. It resides in a process for producing such carpets in a way that the pile will be non-directional, i.e., when looking down on the top of the carpet there will be no evidence of the direction of the tufted lines. The process is particularly useful for producing synthetic grass carpets, sometimes referred to as artificial turf.

In recent years carpets that resemble grass have become increasingly popular for various indoor and outdoor uses. They are used, for example, as patio carpeting, for putting surfaces and tee-off pads, and to cover athletic fields. In much of this carpeting the face fiber is green polypropylene ribbon, which, when tufted at the proper density, resembles grass from a distance. (See, for example, the disclosure in U.S. Pat. No. 3,332,828.)

A problem that has troubled the grass carpet industry is the directionality of the pile, meaning the visibility of the tufting lines, which has been an inherent result of the tufting process. Directionality is a problem for a variety of reasons. Any visible imperfections in a particular cone of facing yarn, such as incorrect color shading or lack of denier continuity (imperfections which occur frequently in polypropylene ribbon), will ordinarily show up as a straight line, or streak, in the pile. Thus these imperfections are easily noticed, lowering the value of the carpet. Carpets with directional lines also have less spring and rebound properties and are crushed down easily. Crushing also changes the surface of the carpet in both texture and color. Also, considerable waste is generated when piecing together a carpet having directional lines. As an example, when using the carpet in a wall-to-wall installation, waste is generated because all the pieces must have their tufted lines running in the same direction, in order for the finished product to be aesthetically pleasing.

I have invented a process of making a cut pile, tufted carpet that is non-directional and, therefore, free of the drawbacks just described. My process comprises the steps of:

(a) knitting a yarn composed of thermoplastic fiber into a deknittable fabric, (b) heating the fabric to a temperature at which the curves and bends generated in the yarn by its knitted configuration are established in the yarn's memory, (c) cooling the fabric to about room temperature, (d) deknitting the cooled fabric and rewinding the yarn under enough tension to restraighten it, (e) tufting the yarn as facing yarn into a primary carpet backing material, forming a cut pile carpet, (f) coating the underside of the carpet with a heat-settable adhesive that, when cured, will help anchor the tufts of yarn in the backing material, and (g) heating the adhesive-coated carpet to a temperature at which the adhesive will set and the facing yarn will reconform to the bends and twists in its memory.

I have found that by using the process just described the facing yarns in the finished product are curved and bent in all different directions, resulting in a non-directional texture for the carpet. Piecing the carpet is thereby facilitated and the carpet exhibits greater rebound properties. Also, the carpets of the present invention have a greater apparent density—as measured visually and by feel—than the same weight carpet prepared by prior art methods. Though after much traffic the carpet face yarns will pack down to a degree, the surface texture will not change substantially. The pile can be revived to its original state by conventional rug shampooing methods, using a nonresidue shampoo. Because of the bends and curves of the facing yarns, streaking is not nearly so much a problem with the carpets of this invention as with the directional carpets of the prior art. Each row of tufts in my carpet tends to blend in with the adjacent rows, eliminating streak definition and making the imperfections far less visible, if detectable at all. This also makes it easier to blend different colors or shades of yarn in a carpet. Two or three different colors of yarn can be creeled A-B-C on a tufting machine, and the present process will yield a finished carpet in which the different colors in the face yarn appear as intermingled dots, rather than rows or stripes. In this manner a tweed-like blending of different color face yarns can be achieved at less expense than by use of the prior art method of twisting two or three different colored yarns together.

The present invention is primarily useful with polyolefin, polyester, or polyamide (nylon) fibers. Thermoplastic carpet fibers made out of such synthetic resins are, of course, well known. Suitable resins include, for example, polypropylene, polyethylene terephthalate, nylon 6, nylon 11, nylon 66, nylon 610, and nylon 611. Spun yarns (made of staple fibers) as well as yarns made of one or more plies of a continuous filament fiber can be used. Blends of thermoplastic fibers, such as nylon with polyester, can be used as well. When spun yarns are used they will preferably be made of nylon or polyester fibers.

Fibers of all shapes can be used in the present process. Ribbon fibers are the most popular for grass carpet, however, because of their greater resemblance to grass blades. Especially preferred for that purpose are fibrillated ribbon fibers, since they produce a carpet pile having random blade widths, much like real grass. (See, for example, U.S. Pat. No. 3,573,147.) The ribbon fibers may be flat, striated (as disclosed, for example, in U.S. Pat. Nos. 3,332,828 (FIG. 4) and 4,061,804 (FIG. 5)), or ribbed (as disclosed, for example, in U.S. Pat. No. 3,837,980).

When ribbon fibers are used it is preferred that they be no greater than about $\frac{3}{4}$ inch wide. Usually they will be at least 1/16 inch wide, but I am not aware of any minimum width required in order to be operable in the present invention. Preferably, however, the ribbon filament will have a denier of at least 100. When the ribbon is greater than $\frac{1}{4}$ inch wide it is preferred to use it in a folded condition. The procedure for folding ribbon yarn is simply pulling the yarn strand or ribbon through a special diameter ceramic eye.

Preferably the yarn is composed of one to three piles of continuous filament, thermoplastic fiber. The yarn will preferably have a total denier of about 600 to 9000.

The knitting of the yarn can be performed using any deknittable stitch. Examples of such are the flat jersey stitch, the purl stitch, and the loopstitch. Knitting stitches are definable in part by the distance between the needles (gauge) and the length of the stitch (depth). For purposes of the present invention it is preferred to use a gauge in the range of about $\frac{1}{4}$ inch to $\frac{3}{4}$ inch and a depth in the range of about $\frac{1}{4}$ inch to $\frac{1}{2}$ inch. The heavier the yarn denier, the longer the gauge and depth. The yarn can be knitted into a tubular fabric or a flat fabric.

After the yarn is knitted into fabric, the fabric is heat treated to establish a permanent memory of the bends and curves of the knit stitch configuration. The temperature of the heat treatment needs to be high enough to fix the bends and curves in the yarn's memory, but not so high as to soften or melt the yarn. (Most thermoplastic fibers used in carpet facing yarns today have melting points of 300° F. or above.) While the preferred memory-instilling temperature will vary with the type of yarn, usually it will be preferred to heat the yarn to a highest temperature in the range of about 230° to 290° F. The preferred range for polypropylene ribbon is about 260° to 280° F.; for other polypropylene fiber it is about 230° to 280° F.; for polyester it is about 230° to 260° F.; and for nylon it is about 230° to 290° F.

The present process works best if the knitted fabric is heated uniformly, meaning that the heat penetrates the tightest regions of the stitches as well as the surface fibers. I have found that that can be accomplished quite well by using a particular heating procedure: first subjecting the fabric to a partial vacuum, and then repeatedly subjecting the fabric to pressurized steam, followed by releasing the steam pressure and allowing the fabric to cool about 20 to 50 degrees (F). Preferably the fabric will be subjected to at least three such steam injections, with the first injection being the mildest, i.e., establishing a lower treatment chamber temperature and for a shorter duration than the subsequent injections. This procedure (vacuum followed by three or more steam surges) may be carried out in a conventional yarn processing autoclave. Preferably the initial evacuation will be to a vacuum of about 23 to 26 inches of mercury. It is also preferred to pull a vacuum on the autoclave after the final steam injection, so as to partially dry the fabric before it is deknitted.

After the heat treatment, the fabric is cooled to at or near room temperature and deknitted, for example on a winder. As it unravels from the fabric, the yarn is rewound under enough tension to straighten it. The higher the denier of the yarn, the more tension that will be required to restraighten it.

The deknitted, restraightened yarn is tufted into primary carpet backing material in the conventional manner for making cut pile carpet, for example using a Wilton cut pile loom or a conventional tufting machine. The present process is most effective if the height of the pile is kept within the range of about $\frac{3}{8}$ inch to about $\frac{7}{8}$ inch and if the face density of the carpet is at least about 10 ounces per square yard.

The present process does not depend upon the use of any special carpet backing materials. Thus, for example, the primary backing material may be woven or non-woven and may be formed of jute or of various synthetic fibers, e.g., polyesters, polyacrylonitrile, polypropylene, or nylon. For carpets that are to be used outdoors, however, water-impervious backing materials, such as woven polypropylene backings, are preferred. Other suitable materials are 5 to 10 ounce, resin-coated, non-woven fabric of acrylic staple fibers, needle punched into a nylon scrim; $\frac{1}{8}$ inch thick polyurethane foam sheet, cast over a woven nylon scrim (e.g., Chemback brand tufting medium from Chemstrand Company); 10 ounce woven acrylic fabric; and non-woven fabric prepared from polyethylene terephthalate staple fibers.

When I refer herein to a heat-settable adhesive being applied to the underside of the primary carpet backing material, I mean any of the heat-cured liquids or pastes that are normally used to anchor the tufts of facing yarn in the primary backing material. Included are liquid cements—such as latex adhesives—that are used to glue a secondary carpet backing to the primary backing; rubber solutions that are used without a secondary backing to provide what are referred to as marine backings; flexible resinous coating compositions—such as non-foaming polyurethane coating compositions—that are used without a secondary backing to provide extremely durable carpets, especially for use on athletic fields; and foam compositions that are cast and cured directly on the underside of the primary backing to provide a resilient backing and underpad, all in one. The present process may be used in making all of these types of carpet.

Examples of suitable liquid cements that can be used to glue a secondary carpet backing to the primary backing material are latexes of natural rubber, styrene-butadiene rubber (SBR), nitryl-butadiene rubber (NBR), and ethylene-vinyl acetate copolymers. As with the primary backing, the choice of the secondary backing material is not believed to be critical to the invention either. Woven and non-woven fabrics can be used, and pre-cast sheet foam material can be used as well. Examples of suitable secondary backing materials include non-woven rayon-polyolefin scrims; foamed, closed cell polyvinyl chloride (PVC) or polyethylene pads; and woven polypropylene fabrics. The use of a secondary backing often gives the carpet greater dimensional stability and better wearing properties. Also, the bounce properties of the carpet can be easily controlled or adjusted by selection and use of a particular secondary backing material.

The gluing of the secondary backing to the primary backing can be done in a latex oven. The temperature used will depend upon the particular cement that is chosen; usually, however, it will be in the range of about 245° to 280° F. (referring to the face temperature, i.e., the temperature of the surface of the pile).

Application of the liquid cement to the underside of the primary backing need not always be for the purpose of gluing a secondary backing to the carpet. If desired, the cement can be heat-set, or cured, without being covered, and the carpet then can be used without further treatment, or a final covering can be applied in a separate operation. In making foam-backed carpets, for example, a latex adhesive can be applied and cured on the underside of the primary backing material, and then the foam can be cast over it in a separate operation.

Marine backings are non-foamed rubber coatings, usually so thin that the texture of the underside of the primary backing material can be seen through the marine backing. Carpets with marine backings are often used on boats (whence comes the name) and in low budget applications. To create a marine backing, the carpet is normally turned face down and a rubber solution is painted on the underside of the primary backing material; then the carpet is heated in a finishing oven. The face temperature used is usually in the range of about 210° to 240° F. The weight of a marine backing is usually about 12 to 18 ounces per square yard of carpet.

Non-foaming resinous coating compositions are used most often on the underside of synthetic grass carpets intended to be subjected to hard wear, for example as the playing surface in an athletic stadium. Most often polyurethane resins are used for this purpose. Such undercoatings provide an extremely tough and durable carpet. Using a special machine, the resinous composition is normally coated onto the underside of the primary backing material, while the carpet is laying face down, at a weight of about 10 to 60 ounces per square yard (cured weight). The coating can be cured in a modified finishing oven, for example at a face temperature in the range of about 230° to 275° F.

Heat-setting foam compositions that can be cast on the back of carpets are likewise well known in the art. They include, for example, polyvinyl chloride plastisols and polyurethane foams. The foaming may be accomplished physically or chemically, and the foams may be open celled or closed celled. Application rates usually will be in the range of about 18 to 36 ounces per square yard (cured weight). The foam can be cast and cured on the carpet in a foam machine. Face temperatures most often will reach a high in the range of about 240° to 275° F. during curing.

Depending, then, on the particular type and composition of the adhesive used, the heating of the adhesive-coated carpet in the process of the present invention will reach a maximum temperature usually in the range of about 210° to 280° F. As already indicated, this heating step serves a dual purpose. It sets the adhesive, while at the same time causing the individual fibers in the facing yarn to bend, twist, and curl in all different directions, in an effort to resume their former configuration in the knitted fabric. In that manner total non-directionality can be achieved.

For illustration purposes, the following procedure describes what I presently contemplate to be one of the best embodiments of practicing my invention to make a synthetic grass carpet for patio use, using fibrillated ribbon as the facing yarn:

Fibrillated, green, continuous filament, polypropylene ribbon, having a denier of 4,500, a twist of one-half turn per inch, and no latent crimp, is knitted into a 12 inch diameter tube. The ribbon is knitted in single ply using a flat jersey stitch, with the gauge set at $\frac{3}{8}$ inch and the stitch depth at $\frac{1}{2}$ inch.

The knitted fabric is placed in a Turbo FS-1200 autoclave and the air in the autoclave is then pumped out to establish a vacuum of 26 inches of mercury, which is maintained for about $1\frac{1}{2}$ minutes. Pressurized steam is then drawn into the evacuated autoclave in an amount to establish an internal temperature of about 260° F. and a pressure of about 20 lbs. (psig). The temperature is held at 260° F. for about 5 minutes, following which the steam release valve is opened to allow the pressure in the autoclave to drop to atmospheric and the temperature to drop to about 230° F. Then the release valve is closed and pressurized steam is injected into the autoclave again to bring the temperature up to about 280° F., where it is held for about 10 minutes. Again the steam pressure is released and the temperature is dropped back to about 230° F., and then, for the third and final time, steam is injected, bringing the temperature back up to about 280° F. After holding the autoclave temperature at about 280° F. for about 10 minutes, the autoclave is again evacuated to about 26 inches of mercury, and it is held there for about one minute. Then air is let into the autoclave to equalize the internal and external pressures, and the fabric is removed.

Once the knitted fabric has cooled to near room temperature, it is deknitted by a winding process, with the yarn being wound onto cones. Sufficient tension is imparted to the yarn (approximately 300 grams) that the bends and curves imparted to it by the knitting operation are restraightened. Now the yarn is ready for tufting, and the cones are moved to the tufting creel.

Figure 4:
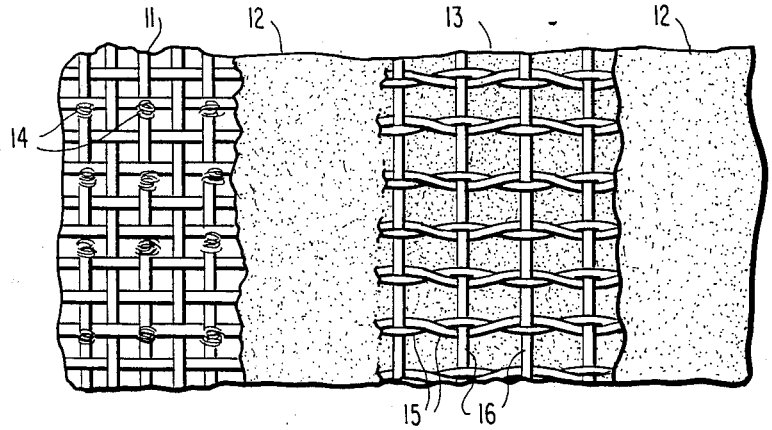

Using a conventional, 3/16 inch guage, cut pile tufting machine, the deknitted yarn is tufted onto a primary backing made of woven polypropylene. The pile height for the fabric is 9/16 inch, and the face weight is 20 ounces per square yard. FIG. 1 of the drawings accompanying this specification illustrates the product at this stage of process. Note how all of the tufts (10) of the facing fiber lean to the right, giving the pile, or face yarns, a directional appearance. The only support for tufts (10) at this stage is the primary backing material (11). As shown in FIG. 4 of the drawings, primary backing (11) is made of polypropylene ribbon woven in a basketweave pattern.

Figure 2:
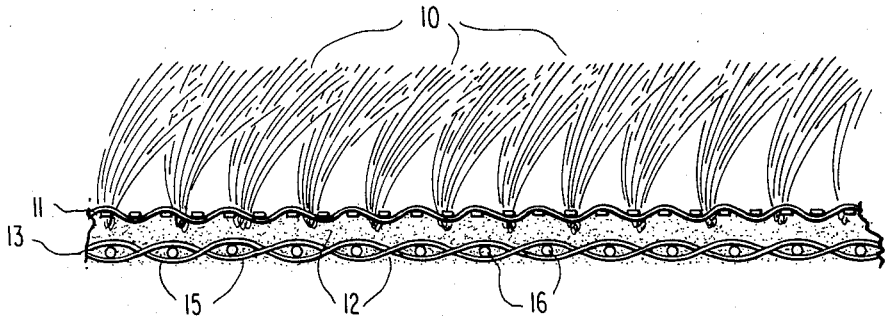

The unfinished carpet of FIG. 1 is fed into a latex oven for lamination to a secondary backing. A latex adhesive is applied to the underside of the unfinished carpet at an application rate of 28 ounces per square yard, and the coated carpet is immediately laid on top of Action Back brand secondary carpet backing, resulting in the laminated structure shown in FIG. 2 of the accompanying drawings. Referring to those drawings, the latex is shown as (12) and the secondary backing as (13). As shown in FIGS. 2 and 4, secondary backing (13) is an open weave fabric composed of polypropylene ribbon warp (15) woven around spun polypropylene filling yarn (16).

Figure 3:
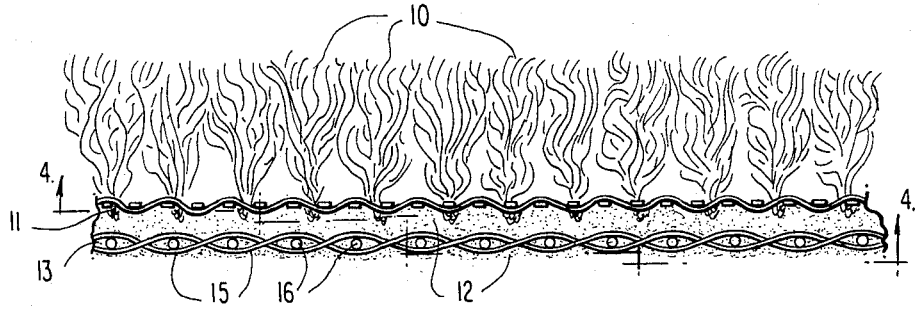

As the final step in the process, the laminated structure shown in FIG. 2 is heated in the latex oven to a face temperature of about 270° F. The heating causes the latex adhesive to set, or cure, and also causes the upstanding tufts of polypropylene ribbon to reconform to the bends, curves, and turns in their memory. The resulting product is shown in FIGS. 3 and 4 of the accompanying drawings. FIG. 4 is a bottom sectional view of the carpet, taken along the line 4—4 in FIG. 3. From left to right, FIG. 4 shows bottom views of the primary backing (11) (in which the bases (14) of the yarn tufts (10) are visible), the cured latex adhesive (12), the secondary backing (13), and more cured adhesive (12). As illustrated in FIG. 3, the individual tufts of facing yarn (10) are now so bent and twisted that the carpet no longer reveals tufting lines and is totally non-directional.

I claim:

1. A process of making a non-directional, synthetic outdoor carpet, comprising the steps of (a) knitting a yarn composed of colored, continuous, polypropylene ribbon into a deknittable fabric, using knitting needles that are set a fixed distance apart, (b) heating the fabric to a temperature at which the curves and bends generated in the yarn by its knitted configuration are established in the yarn's memory, said temperature being in the range of about 230° to 290° F., (c) cooling the fabric to about room temperature, (d) deknitting the cooled fabric and rewinding the yarn under enough tension to restraighten it, (e) tufting the yarn as facing yarn into a primary carpet backing material, forming a cut pile carpet having a pile height greater than the between-needles distance used in step (a) above, (f) coating the underside of the carpet with a heat-settable adhesive that, when cured, will help anchor the tufts of yarn in the backing material, and (g) heating the adhesive-coated carpet to a temperature at which the adhesive will set and the facing yarn will reconform to the bends and twists in its memory, yielding an outdoor carpet in which the facing yarns are curved and bent in all different directions, giving the carpet a non-directional texture.

2. The process of claim 1 wherein the ribbon is flat.

3. The process of claim 1 wherein the yarn is composed of 1 to 3 plies of the ribbon.

4. The process of claim 2 wherein the yarn is composed of 1 to 3 plies of the ribbon.

5. The process of claim 1 wherein the ribbon is flat and fibrillated and has a denier of at least 100 but is no greater than about ¾ inch wide, and the yarn is made of 1 to 3 plies of the ribbon and has a denier of about 600 to 9000.

6. The process of claim 2 wherein the ribbon is fibrillated.

7. The process of claim 4 wherein the ribbon is fibrillated.

8. The process of claim 4 wherein the ribbon is fibrillated and the adhesive is a latex adhesive.

9. The process of claim 1 wherein, in step (a), the knitting is performed at a guage in the range of about ¼ inch to about ¾ inch and a depth in the range of about ¼ inch to about ½ inch.

10. The process of claim 4 wherein, in step (a), the knitting is performed at a guage in the range of about ¼ inch to about ¾ inch and a depth in the range of about ¼ inch to about ½ inch.

11. The process of claim 8 wherein, in step (a), the knitting is performed at a guage in the range of about ¼ inch to about ¾ inch and a depth in the range of about ¼ inch to about ½ inch.

12. The process of claim 5 wherein in step (b) the highest temperature to which the fabric is heated is in the range of about 260° to 280° F.; and in step (g) the adhesive-coated carpet is heated to a face temperature in the range of about 245° to 280° F.

13. The process of claim 12 wherein, in step (a), the knitting is performed at a guage in the range of about ¼ inch to about ¾ inch and a depth in the range of about ¼ inch to about ½ inch.

14. The process of claim 13 wherein, in step (e), the tufting is done to obtain a pile height in the range of about ⅜ to about ⅞ inch and a face density of at least about 10 ounces per square yard.

15. The process of claim 12 wherein, in step (b), the fabric is heated by a procedure involving first subjecting the fabric to a partial vacuum, then repeatedly subjecting the fabric to pressurized steam, followed by releasing the steam pressure and allowing the fabric to cool about 20 to 50 degrees (F.).

16. The process of claim 14 wherein, in step (b), the fabric is heated by a procedure involving first subjecting the fabric to a partial vacuum, then repeatedly subjecting the fabric to pressurized steam, followed by releasing the steam pressure and allowing the fabric to cool about 20 to 50 degrees (F.).

17. The process or claim 14 wherein in step (a) the yarn is knitted using a flat jersey or purl stitch.

18. The process of claim 16 wherein in step (a) the yarn is knitted using a flat jersey or purl stitch.

19. The process of claim 17 wherein between steps (f) and (g) a secondary carpet backing is applied to the adhesive-coated underside of the carpet.

20. A process of making a non-directional, synthetic, grass carpet, comprising the steps of (a) knitting a yarn composed of 1 to 3 plies of green, fibrillated, continuous, flat polypropylene ribbon into a deknittable fabric using a stitch selected from the group consisting of flat jersey, purl, and loop-stitch, said ribbon having a denier of at least 100 but being no greater than about ¾ inch wide, said yarn having a total denier of about 600 to 9000, and said knitting being performed using knitting needles that are set a fixed distance apart, in the range of about ¼ inch to about ¾ inch, and at a depth in the range of about ¼ inch to about ½ inch;

(b) heating the fabric to a temperature at which the curves and bends generated in the yarn by its knitted configuration are established in the yarn's memory, said temperature being in the range of about 260° to 280° F. and said heating being accomplished by a procedure involving first subjecting the fabric to a vacuum of about 23 to 26 inches of mercury, then repeatedly subjecting the fabric to pressurized steam, followed by releasing the steam pressure and allowing the temperature of the fabric to drop about 20 to 50 degrees (F.), (c) cooling the fabric to room temperature, (d) deknitting the cooled fabric and rewinding the yarn under enough tension to restraighten it, (e) tufting the yarn as facing yarn into a primary carpet backing made of polypropylene, forming a cut pile carpet having a pile height greater than the between-needles distance used in step (a) above, said pile height being within the range of about ⅜ to ⅞ inch, and having a face density of at least about 10 ounces per square yard, (f) gluing a secondary carpet backing, also made of polypropylene, to the primary carpet backing using a heat-settable, latex adhesive, and (g) heating the carpet to a temperature in the range of about 245° to 280° F. to set the adhesive and to cause the facing yarn to reconform to the bends and twists in its memory, yielding an outdoor carpet in which the facing yarns are curved and bent in all different directions, giving the carpet a non-directional texture.

21. The process of claim 20 wherein, in step (a), a flat jersey or purl stitch is used.

22. A carpet produced by the process of claim 5.

23. A carpet produced by the process of claim 6.

24. A carpet produced by the process of claim 7, wherein the ribbon has a denier of about 4,500.

25. A carpet produced by the process of claim 8.

26. A carpet produced by the process of claim 11.

27. A carpet produced by the process of claim 18.

28. A carpet produced by the process of claim 17.

29. A carpet produced by the process of claim 19.

30. A carpet produced by the process of claim 20.

31. A carpet produced by the process of claim 21.

* * * * *